United States Patent [19]

Horgan, Jr.

[11] Patent Number: 4,688,406

[45] Date of Patent: Aug. 25, 1987

[54] DEADBOLT LOCK MECHANISM

[75] Inventor: William J. Horgan, Jr., Pittsburgh, Pa.

[73] Assignee: Blumcraft of Pittsburgh, Pittsburgh, Pa.

[21] Appl. No.: 846,928

[22] Filed: Apr. 1, 1986

[51] Int. Cl.[4] ..... E05B 65/08

[52] U.S. Cl. ..... 70/100; 70/134; 70/99; 292/139; 292/167; 292/169.15

[58] Field of Search ..... 70/99, 100, 52, 134, 70/139, 95; 292/139, 140, 150, 165, 167, 169.14, 169.15

[56] References Cited

U.S. PATENT DOCUMENTS

| | | | |
|---|---|---|---|
| 638,404 | 12/1899 | Smith | 292/167 X |
| 1,488,612 | 4/1924 | Phillips | 292/139 X |
| 1,922,043 | 8/1933 | Hines | 292/140 X |
| 2,067,319 | 1/1937 | Haag | 70/462 X |
| 2,352,190 | 6/1944 | Foote et al. | 70/52 X |
| 2,533,023 | 12/1950 | Lickteig | 292/169.15 |
| 2,854,839 | 10/1958 | Eads | 70/139 |
| 2,989,859 | 6/1961 | Eads | 70/116 |
| 3,011,817 | 12/1961 | Eads | 70/134 |
| 3,026,703 | 3/1962 | Welch | 70/134 |
| 3,422,644 | 1/1969 | Foote | 70/52 X |
| 3,606,422 | 9/1971 | Hennessy | 292/139 |
| 3,672,714 | 6/1972 | Schultz | 292/165 X |
| 3,768,285 | 10/1973 | Schwartz | 70/134 |
| 3,783,658 | 1/1974 | Wada | 292/139 X |
| 3,869,159 | 3/1975 | Eads | 70/462 X |
| 3,899,906 | 8/1975 | Bradstock | 70/139 |
| 4,218,903 | 8/1980 | Eads | 70/139 X |
| 4,248,452 | 2/1981 | Allenbaugh | 292/167 |
| 4,268,075 | 5/1981 | Allenbaugh | 292/167 |

FOREIGN PATENT DOCUMENTS

| | | | |
|---|---|---|---|
| 2014230 | 8/1979 | United Kingdom | 70/139 |
| 2101667 | 1/1983 | United Kingdom | 70/95 |

*Primary Examiner*—Gary L. Smith
*Assistant Examiner*—Suzanne L. Dino
*Attorney, Agent, or Firm*—Paul & Paul

[57] ABSTRACT

A deadbolt lock mechanism for a door comprises a lock cylinder secured to a lock housing and having a movable locking tab connected thereto, a lock bolt slidably mounted within a channel in the housing, a disk rotatably mounted within the housing having a transverse pin extending therefrom, and a lever having an opening therein within which a portion of the transverse pin is disposed, the lever being pivotally mounted at one end to the housing and connected at the other end to the lock bolt. Upon rotation of the locking tab, the disk is rotated through actuation of the pin, and the lever is pivoted by the transverse pin engaging the sides of the opening within the lever to slide the lock bolt into an extended locked position or a retracted unlocked position, the lock bolt being deadlocked in position by the detent feature created by the geometrical relationship between the transverse pin and the sides of the opening within the lever.

16 Claims, 7 Drawing Figures

DEADBOLT LOCK MECHANISM

BACKGROUND OF THE INVENTION

This invention relates generally to the field of locks, and more specifically to deadbolt locks for use in a door.

1. Field of the Invention

An essential feature of any lock mechanism is to provide the requisite degree of security to the particular closure member in which the mechanism is to be used. In particular, deadbolt lock mechanisms are often used when the maximum degree of security is desired, such as, for example to prevent unauthorized access to a building through a locked door.

The degree of security offered by a deadbolt lock is a function of two interrelated parameters, namely bolt throw and structural displacement. Bolt throw is the distance that the lock bolt extends from the surface in which it is mounted into an adjacent structure, typically a door jamb or threshold. Structural displacement refers to the size of the opening that needs to be provided in the door to accomodate the lock mechanism, and is directly related to the overall size of the lock housing or casing. These two parameters are in inverse relationship to each other in that the maximum degree of security is obtained when bolt throw is at a maximum while structural displacement is at a minimum. The reasons for the inverse relationship are due to the fact that as bolt throw increases, the degree of security increases in that it becomes increasingly difficult to "spring" or "jimmy" a door open due to the length of the lock bolt disposed within the adjacent structure. Conversely, as the dimensions of a lock housing increase, a correspondingly large opening must be provided in the door to accomodate the lock housing; that is, the structural displacement increases. As the structural displacement increases, larger portions of the door are removed with a resulting decrease in the structural integrity of the door, thus making the door more susceptible to breakage by force and thereby decreasing the degree of security.

From the foregoing, it can be seen that the primary objectives in the art of deadbolt lock mechanisms is to achieve maximum security by maximizing bolt throw while minimizing the overall dimensions of the lock mechanism. Stated simply, it is a primary objective to reduce the size of the lock housing and then take full advantage of the dimension of the housing to achieve a maximum bolt throw.

2. Prior Art

In an effort to achieve the above-described objectives, numerous lock mechanisms have been developed and patented. Initially, these known devices, such as those disclosed in U.S. Pat. Nos. 3,026,703 and 3,011,817, provided a lock mechanism in which the bolt was actuated directly by use of a locking tab attached to the lock cylinder. In these devices, as the locking tab is rotated, it contacts a spring-loaded plunger detent which is then moved, against the force of the spring and in a direction transverse to the direction of the bolt movement, to a position whereby the bolt can be slid into its locked or unlocked position. Further rotation of the locking tab engages the tab with the bolt and the bolt is then pushed into position by the tab, at which time the plunger detent is moved in the opposite direction by the force of the spring to deadlock the bolt. These locks suffer the disadvantage in that the amount of bolt throw that can be achieved is limited to the portion of the arcuate motion of the tab that can be utilized to push the bolt into position. A further disadvantage of these known lock mechanisms is that they often require a number of moving parts in complex relationship and are thus costly and time consuming to manufacture and assemble. Still another disadvantage of these locks is that they often require modification of the locking tab, which also adds an additional cost to manufacture of the lock.

Other lock mechanisms are known, such as those disclosed in U.S. Pat. Nos. 2,854,839, 2,989,859, 3,899,906 and 4,218,903, which utilize a lever and swinging pivot bolt arrangement to increase the bolt throw. These mechanisms also utilize a spring-urged latching detent to deadlock the bolt in position and thus suffer from the same manufacture and assembly disadvantages noted above. Furthermore, in order to accommodate the lever and the swinging bolt, the size of the housing or casing of these locks and thus the structural displacement of the door, is undesirably large. Moreover, because the swinging bolt pivots into a locked or unlocked position, the bolt-receiving opening in the door jamb or threshold must be large enough to accomodate the arcuate path of the bolt, thus resulting in a large structural displacement within the receiving surface, which is also undesirable.

SUMMARY OF THE INVENTION

The present invention offers a maximum bolt throw from a lock mechanism of minimal size and structural displacement. The invention is simple in construction and operation and has a minimum number of moving components, and thus facilitates manufacture, assembly and installation. The invention thus provides an improvement over other lock mechanisms by offering maximum security without the disadvantages of known lock mechanisms.

Briefly, the present invention comprises a lock housing, a lock cylinder having a movable locking tab mounted on the housing, a disk rotationally movable, via a transverse abutment extending from the disk, in response to movement of the locking tab, an actuating lever pivotally mounted at one end to the housing and connected at the other end to a lock bolt, with the actuating lever being pivotally movable in response to the rotational movement of the disk by providing the lever with an opening intermediate its ends and positioned so that the transverse abutment is partially disposed within the opening, and having the lock bolt slidably mounted within a channel in the housing and being selectively slidable into an extended or retracted position relative to the lock housing in response to the pivotal movement of the actuating lever. A locking detent feature is created solely by the geometrical relationship between the transverse abutment and the sides of the opening within the lever to deadlock the bolt into the extended or retracted position.

In a preferred embodiment of the invention, the lock housing comprises a laminated structure having a plurality of plates secured together in coplanar relationship which allows for the overall depth of the lock housing to be increased, if desired.

In another preferred embodiment, the transverse abutment is a single pin carried by a disk and extending therethrough in cooperative engagement with the locking tab and the opening within the actuating lever.

In still another embodiment, the opening within the actuating lever is triangle-shaped and the locking detent feature is achieved in that a line normal to the side of the triangular opening in contact with the transverse abutment, at the point of contact, passes below the center of rotation of the disk.

Accordingly, it is an object of the invention to provide a novel deadbolt lock mechanism that offers maximum security.

It is a further object of the invention to achieve the above object by simultaneously providing maximum bolt throw and minimal structural displacement of the door.

It is a further object of the invention to provide a novel deadbolt lock mechanism that takes full advantage of the dimension of the lock housing to achieve the above objects.

It is still another object of the invention to achieve the above objects by providing a lock mechanism that utilizes a disk and an actuating lever in mutually exclusive cooperative engagement with a transverse pin.

It is a further object of the invention to achieve all of the above objects by providing a lock mechanism which is simple in construction and operation and thus facilitates manufacture, assembly and installation.

These and other objects of the invention will become apparent from the following detailed description with reference to the accompanying drawings and the appended claims.

DETAILED DESCRIPTION OF THE EMBODIMENTS

Figure 1:
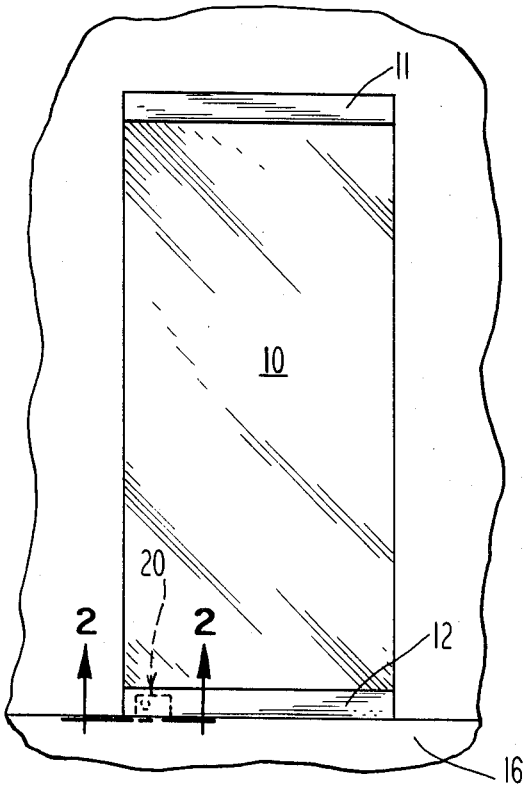
FIG. 1 is a front elevational view of a glass door having the invention illustrated in phantom and positioned in the door shoe assembly thereof for engagement with the threshold of the door.

Referring now to the drawings in detail, and beginning with FIG. 1, illustrated therein is a glass door 10 having a brass shoe assembly 11,12 at the upper and lower horizontal edges of door 10, respectively. The invention, illustrated in phantom and designated generally as 20, is shown positioned inside of the bottom shoe assembly 12 for locking engagement with door threshold 16.

Figure 2:
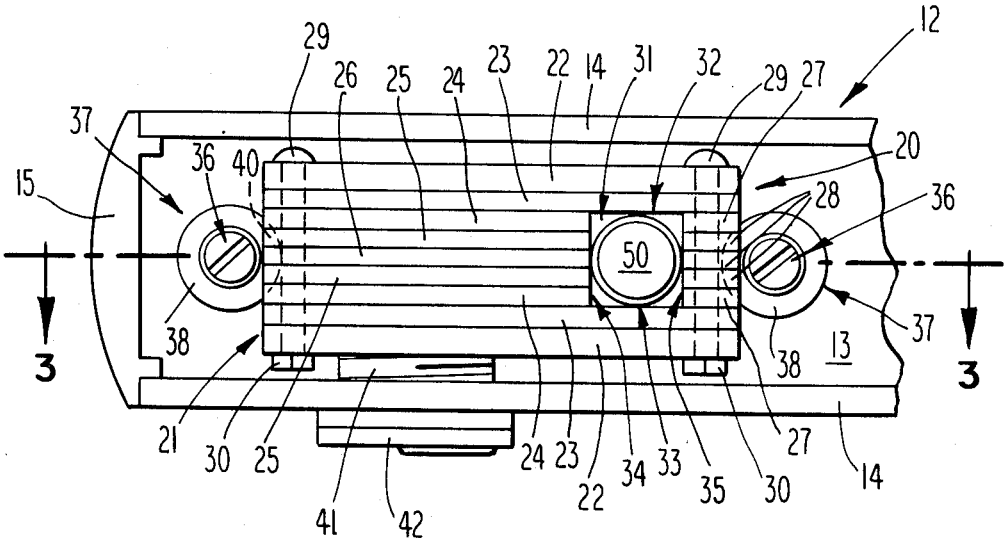
FIG. 2 is an upward-looking sectional view of the threshold-engaging surface of the invention as viewed along line 2—2 of FIG. 1.

With reference now to FIG. 2, the invention 20 is shown in mounting position within web 13 of door shoe 12. Web 13 is a hollow cavity defined by shoe wall portions 14,14 and end cap 15.

As shown in FIG. 2, lock housing 21 is preferably a laminated structure having a plurality of plates 22–26 and bars 27–28 in coplanar relationship and secured together by bolts 29 and nuts 30, or other conventional securement means.

Housing plates 22,22 are preferably brass and serve to define the external surfaces of the lock housing. Working inwardly from housing plates 22,22, plates 23,23 are provided which are preferably plastic. Plates 23,23 are of the same general dimensions as housing plates 22, but slightly thinner. Immediately adjacent plates 23 is a pair of short plates 24,24, also preferably plastic which are the same general thickness as plates 23, and are shorter. Internal plates 25,25 are preferably brass and are the same general size as plates 24, except for thickness. A pair of retainer arms 26, also preferably made of brass, occupy the center of housing 21 and are shaped to compliment the pivoting motion of the lever within the lock mechanism. The particular shape of retainer arms 26 is perhaps best seen in FIGS. 3 and 4.

Spacer bars 27–28 complete the lock housing 21, and are preferably made of the same material as their corresponding plate. For example, bars 27,27, corresponding to plates 24, would preferably be plastic while bars 28,28,28, corresponding to plates 25 and arms 26, are preferably brass. Also, it is desirable that the corresponding bar be the same thickness as its respective spacer plate. It is then advantageous, when desired, to increase the depth of the housing 21 by simply adding additional spacer plates 24 and corresponding bars 27, or by adding long spacer plates 23 to the mechanism as shown in FIG. 2.

As can be seen from FIG. 2, the plates of the laminated structure of housing 21 define channel 31 which closely receives lock bolt 50 for sliding engagement therein. Channel 31 is defined by horizontal edges 32,33 and vertical edges 34,35, with spacer plates 23,23 defining the horizontal edges 32,33, short plates 24–26 defining vertical edge 34, and bars 27–28 defining the vertical edge 35.

The lock housing 21 is secured to the upper edge of web 13 in door shoe 12 by screws 36 and retaining collars 37. Retaining collars 37 comprise a ring member 38 and a sleeve member 39, with ring member 38 being in securing engagement within groves 40 in the ends of lock housing 21. See FIG. 3.

A lock cylinder 41 is provided and is threadably secured through a threaded circular opening (not shown) in housing plate 22 of lock housing 21. A lock cylinder collar 42 is positioned on that portion of the lock cylinder 41 that extends outside of wall 14 of web 13 of door shoe 12. The lock cylinder collar 42 is preferably brass to match the surface of wall 14 of door shoe 12 for asthetic purposes.

The internal construction of the invention will now be described with reference to FIGS. 3–5.

As can be seen in the Figures, lock cylinder 41 has a locking tab 43 connected thereto which rotates upon actuation of the lock cylinder 41 such as, for example, by appropriate movement of a key (not shown) in lock cylinder 41. When lock cylinder 41 is threaded into housing 21, the locking tab 43 is disposed inside of housing 21. See FIG. 5. Position in front of locking tab 43, as viewed in FIG. 3, is disk 44 which is disposed within circular opening 45 of spacer plate 25 in loose-fitting relationship. Carried by disk 44 and extending therefrom is a transverse abutment which, in the embodiment shown, is a single transverse pin 46 that extends through disk 44. See FIG. 5. As seen in the Figures, transverse pin 46 is positioned so as to be engaged by locking tab 43 when locking tab 43 is rotated.

Figure 3:
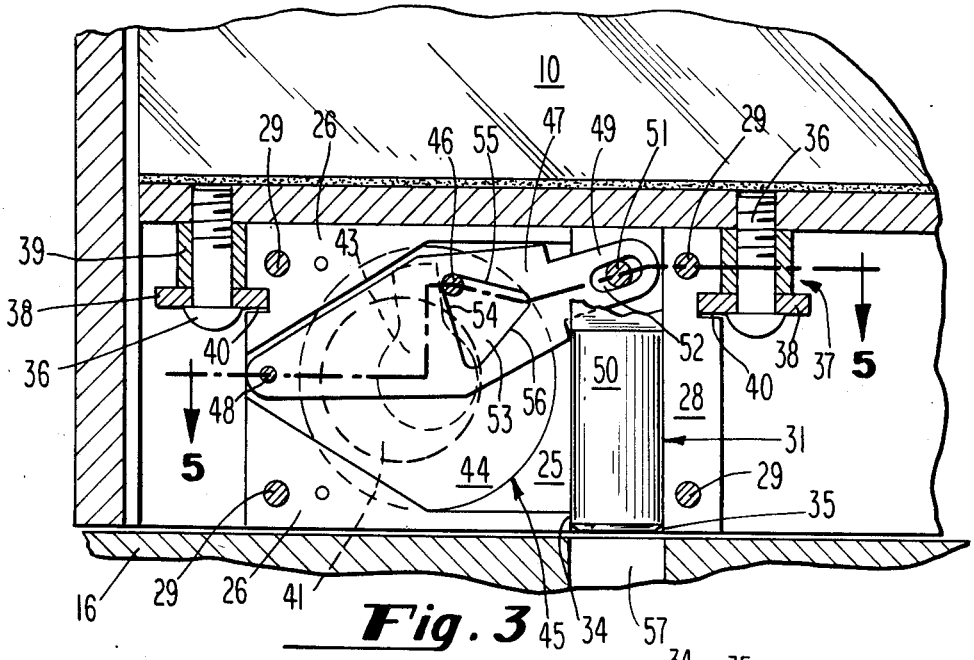
FIG. 3 is a longitudinal sectional view of the invention as seen generally along line 3—3 of FIG. 2.
Figure 4:
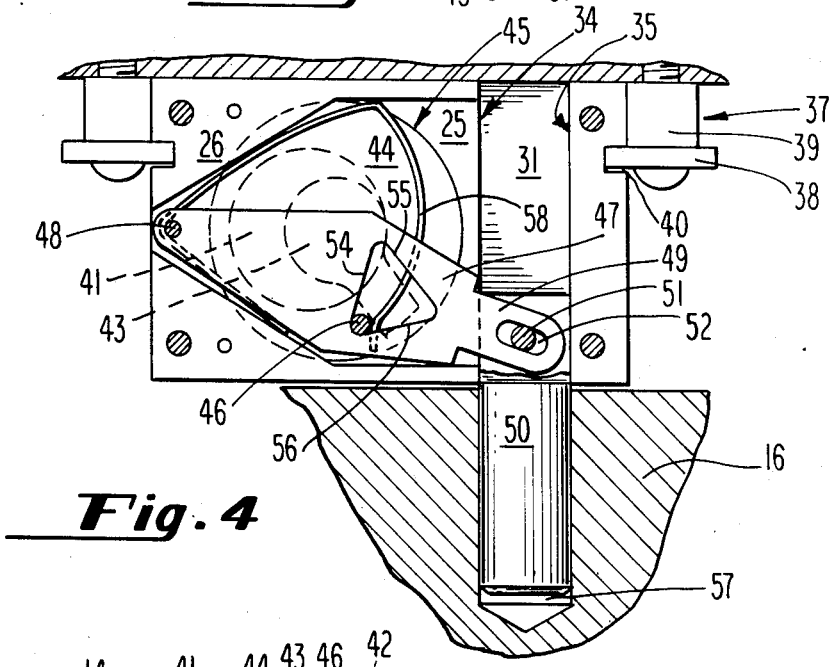
FIG. 4 is a sectional view similar to that of FIG. 3 with the invention being illustrated in the extended locked position.

Directly in front of disk 44 as viewed in FIGS. 3 and 4 is an actuating lever 47 which is pivotally mounted at one end to lock housing 21 by pivot pin 48 and connected at a slotted end 49 to lock bolt 50 by bolt pin 51 disposed in slot 52 of slotted end 49 of the actuating lever 47. Intermediate its respective ends, actuating lever 47 has an opening therein which, in the embodiment illustrated, is a triangle-shaped opening 53 defined by base edge 54 and converging sides 55,56. The triangular opening 53 is positioned to receive transverse pin 46 therein such that, when lock bolt 50 is fully retracted as in FIG. 3, the transverse pin 46 occupies the corner of triangular opening 53 defined by base edge 54 and converging side 55. Conversely, when the lock bolt 50 is fully extended as in FIG. 4, transverse pin 46 occupies the corner of opening 53 defined by base edge 54 and converging side 56.

When the lock mechanism is actuated from the unlocked position as in FIG. 3 to the locked position as shown in FIG. 4, locking tab 43 is rotated in a clockwise direction, as viewed in the Figures, whereupon engagement with transverse pin 46 will cause disk 44 to rotate simultaneously with the rotation of tab 43. As pin 46 rotates clockwise, it engages converging side 56 of triangular opening 53 and pivots actuating lever 47, thus sliding lock bolt 50 from channel 31 into a receiving port, such as for example receiving channel 57 in threshold 16. A spring, such as flat spring 58 in FIG. 4 may be provided, if desired, to give the mechanism a "snap" or "feel" by first resisting and then assisting the rotation of transverse pin 46. Although a spring is not necessary for the invention to function properly, it may be advantageous to provide a "snap" action to the mechanism for the psychology of the consumer.

Figure 5:
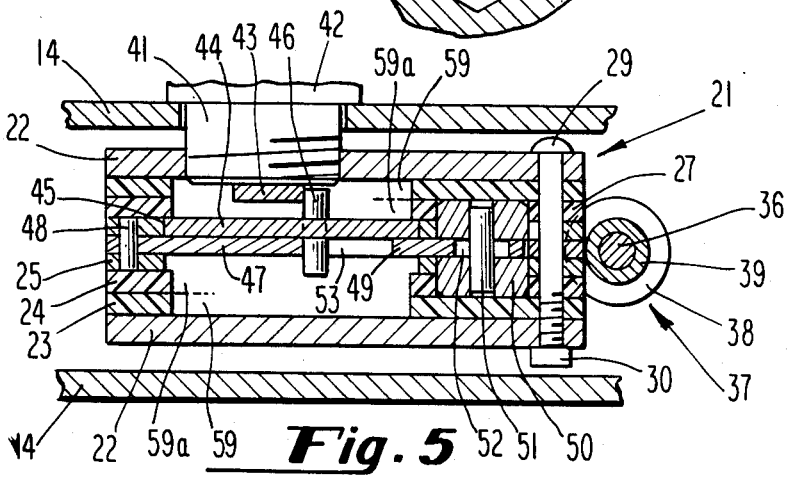
FIG. 5 is a sectional view of the invention taken generally along line 5—5 of FIG. 3.

FIG. 5 illustrates the coplanar relationship of disk 44, locking tab 43 and actuating lever 47 in accordance with the invention. Also clearly shown is the transverse pin 46 in simultaneous engaging relationship with tab 43, disk 46 and opening 53 in lever 47. Although a single transverse pin is shown, it will be obvious to those skilled in the art that a pair of transverse pins, each extending from an opposite face of disk 44, may be used to accomplish the above-described function of transverse pin 46. Furthermore, although it is preferably for the transverse abutment to be a pin, it will be obvious that other abutment shapes may be used, if desired. In addition to these modifications, it is also contemplated that an additional disk or lock cylinder or both may be provided in mirror image to the disk 44 and cylinder 41 in FIG. 5, if it is desirable to have a lock cylinder on either side of the door.

Also illustrated in FIG. 5 are openings **59,59*a* in spacer plates 23 and 24, respectively, which are circular when viewed in plan and which provide a cavity inside housing 21 for receiving the rotational movement of locking tab 43 and transverse pin 46. It will also be noted that circular openings 59,59*a* are slightly smaller in diameter than circular opening 45 in spacer plate 25 to assist in keeping disk 44 in opening 45**.

Figure 6A:
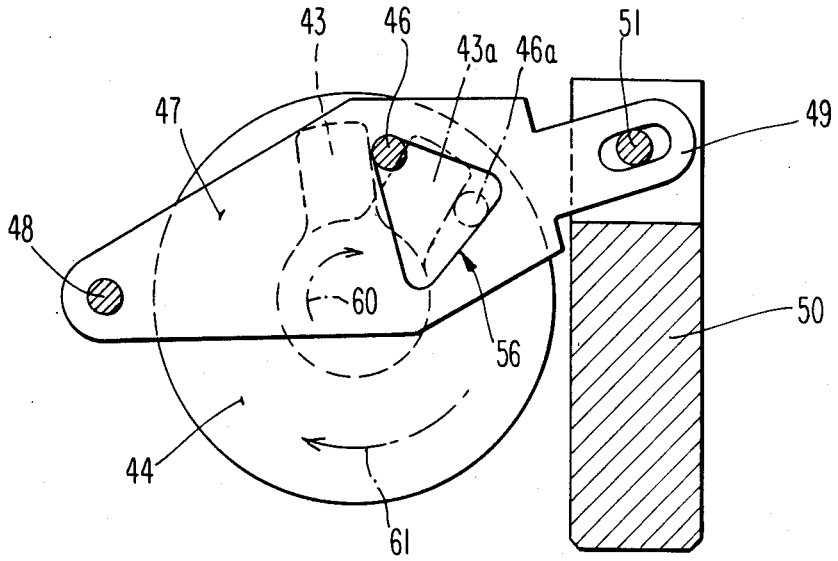
FIGS. 6A and 6B are slightly enlarged, isolated views of the moving components of the invention, shown without the lock housing, illustrating the motion of the components in step-wise fashion.

The actuating mechanics of the invention will now be described in detail with reference to FIGS. 6A and 6B. FIG. 6A illustrates the moving components of the invention in the beginning stage of actuation; that is, the fully retracted or unlocked position, in solid lines. From the unlocked position, as illustrated in FIG. 6A, locking tab 43 is rotated in the clockwise direction of arrow 60 whereupon it engages transverse pin 46, at which time transverse pin 46 and disk 44 are also rotated clockwise in the direction of arrow 61. At this point, tab 43 and transverse pin 46 have reached the positions designated **43*a* and 46*a*, respectively, and illustrated in broken lines. It will be noted that transverse pin 46 is now in engagement with converging side 56 of triangular opening 53 in actuating lever 47 and that the actuating lever 47 and lock bolt 50 have remained in their original unlocked position despite the rotation of disk 44 and transverse pin 46. Further clockwise rotation of locking tab 43 will initiate the pivoting of actuating lever 47 by way of transverse pin 46 engaging the converging side 56 of opening 53**.

Figure 6B:
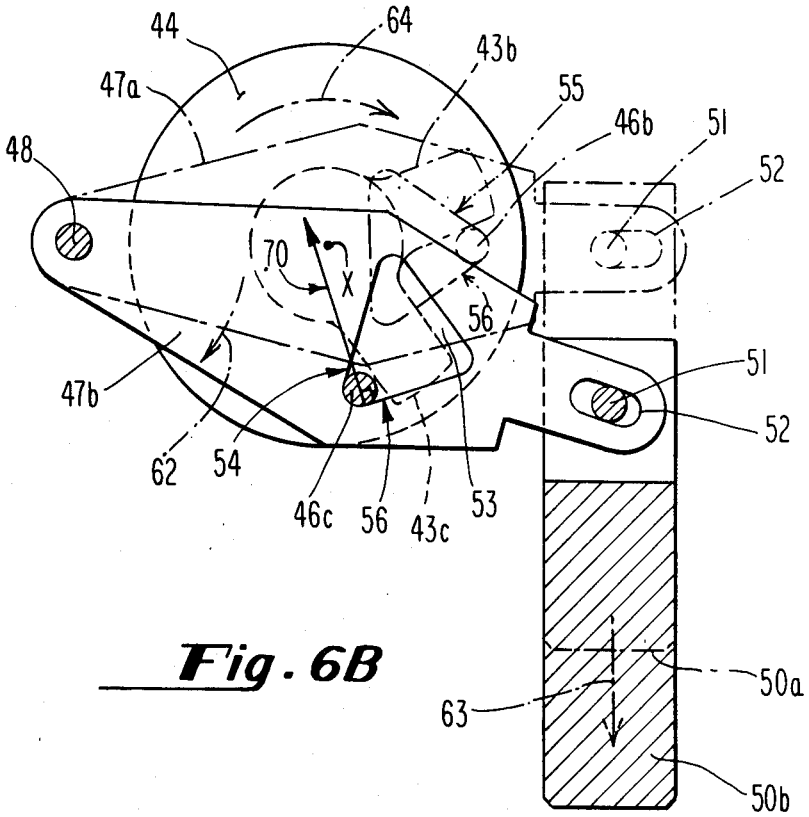

Referring now to FIG. 6B, illustrated therein in broken lines is the approximate half-way point between the locked and unlocked positions. As can be seen, actuating lever 47 has been pivoted in the direction of arrow 62 and lock bolt 50 slid in the direction of arrow 63 into the positions designated as **47*a* and 50*a*, respectively. In this position, transverse pin 46 is now in the righthand corner of triangular opening 53; that is the position designated as 46*b* and, at the same time, bolt pin 51 has moved to the lefthand side of slot 52 as lock bolt 50 has been moved downward. As shown in FIG. 6B, at the half-way point, pivot pin 48, transverse pin 46 (in position 46*b*) and bolt pin 51** are in a generally linear arrangement to one another.

From the half-way point, further clockwise rotation of tab 43 will cause transverse pin 46 and disk 44 to also rotate clockwise in the direction of arrow 64, which, in turn, will cause actuating lever 47 to pivot in the direction of arrow 62 and bolt 50 will slide in the direction of arrow 63 until the fully extended, locked position is reached, as illustrated in solid lines in FIG. 6B. It will be understood that during unlocking of the invention, exactly the same movements occur in exactly the same order, except in the reverse direction as above-indicated for locking the invention.

As mentioned previously herein, the geometrical relationship between the transverse pin 46 and the triangular opening 53 within the actuating lever 47 is such that a locking detent feature is created to deadlock the lock bolt 50 in the extended or retracted position. More specifically, and with reference to FIG. 6B, when the invention is in the extended, locked position, transverse pin 46 is in the position designated as **46*c*; that is, the transverse pin is disposed in the corner of opening 53 defined by base edge 54 and converging side 56. Any force applied to bolt 50 would be transmitted to actuating lever 47 and then to transverse pin 46 via converging side 56 of triangular opening 53. From principles of physics, it is known that a force applied to pin 46 through converging side 56 would be transmitted in a direction normal to converging side 56 at the point of contact with transverse pin 46. Force vector 70 of FIG. 6B illustrates this principle of physics as applied to the present invention. Using this known principle, the opening 53 is designed such that a vector drawn normal to the side of the opening in contact with the transverse pin at the point of contact, such as vector 70, passes below the center of rotation of the disk 44. With reference to FIG. 6B, it can be seen that vector 70 passes to the left of the center of rotation x of disk 44. As long as this relationship between the vector and the center of rotation is maintained, it is impossible to rotate disk 44** through a force applied, either directly or indirectly, to the actuating lever and thus the mechanism remains deadlocked in position. It should be noted that the same detent feature is achieved when the invention is in the unlocked position illustrated in FIG. 6A by the same principles discussed hereinabove.

The foregoing disclosure is illustrative of preferred forms of the invention and is not to be viewed as a limitation of the invention, and it is to be understood that various modifications or equivalents may suggest themselves, all of which are within the spirit and scope of the invention, the boundaries of which are intended to be defined by the appended claims.

What is claimed is:

1. A lock mechanism for a door; comprising:
(a) a lock housing;
(b) lock cylinder means secured to said housing, said cylinder means having movable locking tab means connected thereto;
(c) a lock bolt disposed within a channel in said housing, said lock bolt being slidably movable into an extended or retracted position relative to said housing;
(d) an actuating lever pivotally mounted at one end to said housing and connected at the other end to said lock bolt, said lever having a triangular-shaped opening therein intermediate its ends; and
(e) a rotationally mounted disk within said housing having at least one transverse abutment extending therefrom, said disk being rotatably movable in response to movement of said locking tab means, wherein said transverse abutment comprises means for rotating said disk in response to movement of said locking tab means and cooperates with said triangular-shaped opening to comprise means for facilitating the pivoting of said actuating lever so that said lock bolt is slidably moved into the extended or retracted position.

2. The lock of claim 1, wherein said transverse abutment and said opening comprise locking detent means for locking said lock bolt in the extended or retracted position.

3. The lock of claim 1, wherein said lock housing comprises a plurality of coplanar plates and includes securement means for securing said plates together.

4. The lock of claim 1, including spring means engaging said transverse abutment for first resisting and then assisting the rotation of said disk.

5. The lock of claim 1, wherein said at least one transverse abutment comprises a single transverse pin extending through said disk.

6. A lock mechanism for a door, comprising:
(a) a lock housing;
(b) lock cylinder means secured to said housing, said lock cylinder means having movable locking tab means connected thereto;
(c) a disk rotationally movable in response to movement of said locking tab means;
(d) a lever pivotally movable in response to rotational movement of said disk;
(e) a lock bolt slidably movable into an extended or retracted position relative to said housing in response to pivotal movement of said lever; and
(f) at least one transverse abutment carried by said disk and extending therefrom, said at least one transverse abutment comprising means for rotating said disk in response to movement of said locking tab means;
(g) wherein said lever has an opening therein cooperating with said at least one transverse abutment, said opening and said at least one transverse abutment comprising means for pivoting said lever in response to rotational movement of said disk.

7. The lock of claim 6, wherein said opening is triangle-shaped, and wherein said at least one transverse abutment is a pin extending through said disk capable of simultaneous engagement with said locking tab means and said opening within said lever.

8. The lock of claim 7 wherein a line normal to the side of said triangular opening at the point of contact with said transverse pin passes below the center of rotation of said disk when said lock bolt is in the fully extended or fully retracted position.

9. A lock mechanism for a door, comprising:
(a) a lock housing;
(b) lock cylinder means connected to said housing and having movable locking tab means connected thereto;
(c) a rotatable member disposed within said housing for rotational movement in response to movement of said locking tab means;
(d) a lever pivotally movable in response to rotational movement of said member;
(e) a lock bolt selectively movable between extended and retracted position relative to said housing; and
(f) at least one transverse abutment carried by said member and extending therefrom, said at least one transverse abutment comprising means for rotating said member in response to movement of said locking tab means;
(g) wherein said lever has an opening therein in cooperative engagement with said at least one transverse abutment, said opening and said at least one transverse abutment comprising means for pivoting said lever in response to rotational movement of said member.

10. The lock of claim 9, wherein said lock housing comprises a plurality of coplanar plates and including securement means for securing said plates together.

11. The lock of claim 9, wherein said rotatable member is disk-like.

12. The lock of claim 9, wherein said rotatable member is a disk.

13. The lock of claim 9, wherein said opening in said lever is triangle-shaped.

14. The lock of claim 9, wherein said opening comprises means for dwelling the pivoting of said lever relative to the rotation of said member.

15. The lock of claim 9, wherein said opening and said at least one transverse abutment comprise locking detent means for locking said lock bolt in the extended and retracted positions.

16. The lock of claim 9, wherein said opening is triangle-shaped and wherein said at least one transverse abutment comprises a single pin extending through said member and capable of simultaneous engagement with said locking tab means and said opening within said lever.

* * * * *